US009624924B2

(12) United States Patent
Chou

(10) Patent No.: US 9,624,924 B2
(45) **Date of Patent: *Apr. 18, 2017**

(54) AIR COMPRESSOR HAVING ENLARGED COMPARTMENT FOR RECEIVING PRESSURIZED AIR

(71) Applicant: Wen San Chou, Tainan (TW)

(72) Inventor: Wen San Chou, Tainan (TW)

( * ) Notice: Subject to any disclaimer, the term of this patent is extended or adjusted under 35 U.S.C. 154(b) by 399 days.

This patent is subject to a terminal disclaimer.

(21) Appl. No.: 14/260,723

(22) Filed: Apr. 24, 2014

(65) Prior Publication Data

US 2014/0234135 A1 Aug. 21, 2014

Related U.S. Application Data

(63) Continuation-in-part of application No. 12/927,472, filed on Nov. 16, 2010, now Pat. No. 8,747,083.

(51) Int. Cl.
*F04B 49/22* (2006.01)
*F04B 35/04* (2006.01)

(52) U.S. Cl.
CPC ..... *F04B 49/22* (2013.01); *F04B 35/04* (2013.01)

(58) Field of Classification Search
CPC .... F04B 39/125; F04B 39/127; F04B 39/122; F04B 39/1073; F04B 35/04; F04B 41/02; F16J 12/00; F15B 15/1428
USPC ..... 92/169.1
See application file for complete search history.

(56) References Cited

U.S. PATENT DOCUMENTS

| | | | | |
|---|---|---|---|---|
| 5,174,735 | A * | 12/1992 | Gannaway | F04B 39/0016 137/516.21 |
| 6,193,475 | B1 * | 2/2001 | Rozek | F04B 35/04 417/360 |
| 6,213,725 | B1 | 4/2001 | Chou | |
| 6,514,058 | B1 | 2/2003 | Chou | |
| 6,655,928 | B2 | 12/2003 | Chou | |
| 6,846,162 | B2 | 1/2005 | Chou | |
| 7,240,642 | B2 | 7/2007 | Chou | |
| 7,462,018 | B2 | 12/2008 | Chou | |
| 2004/0115075 | A1 * | 6/2004 | Chen | F04B 35/04 417/415 |
| 2007/0065311 | A1 * | 3/2007 | Chou | F04B 39/123 417/415 |

* cited by examiner

*Primary Examiner* — William H Rodriguez
*Assistant Examiner* — Christopher Brunjes
(74) *Attorney, Agent, or Firm* — Charles E. Baxley

(57) ABSTRACT

An air compressor includes a cylinder housing, an outlet receptacle disposed on the cylinder housing, and a partition formed between the cylinder housing and the outlet receptacle and having an air passage formed in the partition, a piston slidably received in the cylinder housing and coupled to a motor for moving relative to the cylinder housing in a reciprocating action in order to generate a pressurized air, and a spring-biased check valve engaged with the partition for selectively blocking the air passage of the partition, the outlet receptacle includes an inner diameter "D2" no less than an inner diameter "D1" of the cylinder housing for allowing the pressurized air to easily flow into the outlet receptacle and for allowing the piston to be moved in a greater moving speed.

1 Claim, 11 Drawing Sheets

AIR COMPRESSOR HAVING ENLARGED COMPARTMENT FOR RECEIVING PRESSURIZED AIR

BACKGROUND OF THE INVENTION

1. Field of the Invention

The present invention relates to an air compressor, and more particularly to an air compressor having an enlarged compartment for receiving a pressurized air and for effectively compressing or pumping the air in the pumping movement or stroke and/or for suitably increasing the compressing or pumping effect or operation to the air.

2. Description of the Prior Art

Typical air compressors comprise a cylinder housing attached or secured to a base and having a piston slidably disposed therein, and a motor secured to the base and coupled to the piston of the cylinder housing for actuating or driving the piston of the cylinder housing in a reciprocating action, in order to generate a pressurized air of a greater air pressure and a decreased flowing quantity and for supplying the pressurized air to inflate various air facilities, such as tires, air beds, air cushions, hovercrafts, etc.

The cylinder housing normally includes an outlet receptacle having a compartment formed therein and having one or more outlet ports communicative with the compartment of the outlet receptacle for selectively or changeably attaching and securing or coupling various parts or elements or attachments or facilities, such as the pressure gauges, the air nozzles, the relief valves, the safety valves or the like.

The applicant has developed various kinds of typical air compressors, including at least U.S. Pat. No. 6,213,725 to Chou, U.S. Pat. No. 6,514,058 to Chou, U.S. Pat. No. 6,655,928 to Chou, U.S. Pat. No. 6,846,162 to Chou, U.S. Pat. No. 7,240,642 to Chou, and U.S. Pat. No. 7,462,018 to Chou each of which also comprise a piston slidably disposed within a cylinder housing, a spring valve having one end secured to the piston and having the other end for selectively blocking an air aperture of the piston, in order to control the air to flow through the piston, and a motor secured to the base and coupled to the piston of the cylinder housing for actuating or driving or forcing the piston of the cylinder housing to move in the reciprocating action relative to the cylinder housing, and an outlet receptacle extended or formed on top of the cylinder housing and having a compartment formed therein for receiving the pressurized air from the cylinder housing and having one or more outlet ports communicative with the compartment of the outlet receptacle for selectively or changeably attaching and securing or coupling various parts or elements or attachments or facilities, such as the pressure gauges, the air nozzles, the relief valves, the safety valves or the like.

However, all the outlet receptacles of the prior arts include a reduced or narrowed or decreased compartment formed therein and having a volume or dimension or size smaller than that of the chamber of the cylinder housing such that the pressurized air may not be effectively pumped or forced into the reduced or narrowed or decreased compartment of the outlet receptacle, and such that the piston may not be effectively moved relative to the cylinder housing and may not be effectively operated to compress or pump the air in the pumping movement or stroke.

The present invention has arisen to mitigate and/or obviate the afore-described disadvantages of the conventional structures for the air compressors.

SUMMARY OF THE INVENTION

The primary objective of the present invention is to provide an air compressor including an enlarged compartment for receiving a pressurized air and for effectively compressing or pumping the air in the pumping movement or stroke and/or for suitably increasing the compressing or pumping effect or operation to the air.

In accordance with one aspect of the invention, there is provided an air compressor comprising a cylinder housing including a chamber formed therein, an outlet receptacle provided on the cylinder housing and including a compartment formed therein, and including a partition provided between the cylinder housing and the outlet receptacle, and including an air passage formed in the partition and communicative with the chamber of the cylinder housing for receiving a pressurized air from the chamber of the cylinder housing, and communicative with the compartment of the outlet receptacle, a piston slidably received in the chamber of the cylinder housing and having a piston rod extended therefrom, a motor coupled to the piston for moving the piston relative to the cylinder housing in a reciprocating action in order to generate a pressurized air and for allowing the pressurized air to be supplied from the chamber of the cylinder housing to the compartment of the outlet receptacle, and a spring-biased check valve disposed in the outlet receptacle and engaged with the partition for selectively blocking the air passage of the partition and for guiding the pressurized air to flow from the chamber of the cylinder housing into the compartment of the outlet receptacle, and to prevent the pressurized air from flowing backwardly from the compartment of the outlet receptacle into the chamber of the cylinder housing, the compartment of the outlet receptacle includes an inner diameter "D2" no less than an inner diameter "D1" of the chamber of the cylinder housing for allowing the pressurized air to easily flow into the outlet receptacle and for allowing the piston to be moved in a greater moving speed.

The cylinder housing includes a number of pegs extended from the partition and extended into the compartment of the outlet receptacle, and includes a number of gaps formed between the pegs, and includes a space formed within the pegs for slidably receiving and confining the check valve. The space formed within the pegs includes an inner diameter greater than that of the air passage of the partition.

The outlet receptacle includes a cover having an extension extended into the compartment of the outlet receptacle and extended and directed toward the check valve, and a spring biasing member engaged between the extension of the cover and the check valve for biasing and forcing the check valve to selectively engage with the partition and to selectively block and seal the air passage of the partition.

The cover includes a protrusion extended from the extension for engaging with and for retaining the spring biasing member. The outlet receptacle includes a peripheral flange for engaging with the cover.

The outlet receptacle includes a number of pins extended outwardly from the peripheral flange, and the cover includes a number of orifices formed therein for receiving and engaging with the pins and for securing the cover to the outlet receptacle with the pins.

The outlet receptacle includes a peripheral recess formed in the peripheral flange for selectively engaging with a sealing ring which is engaged with the cover. The outlet receptacle includes a peripheral fence extended from the extension for partially engaging with the pegs.

The outlet receptacle includes a peripheral wall extended into the compartment of the outlet receptacle and located around the extension for forming an annular space between the extension and the peripheral wall and for partially engaging with the pegs.

The cylinder housing includes a peripheral fence extended from the partition and extended into the compartment of the outlet receptacle and located around the pegs. The check valve includes a spring blade attached to the partition for selectively blocking and sealing the air passage of the partition.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
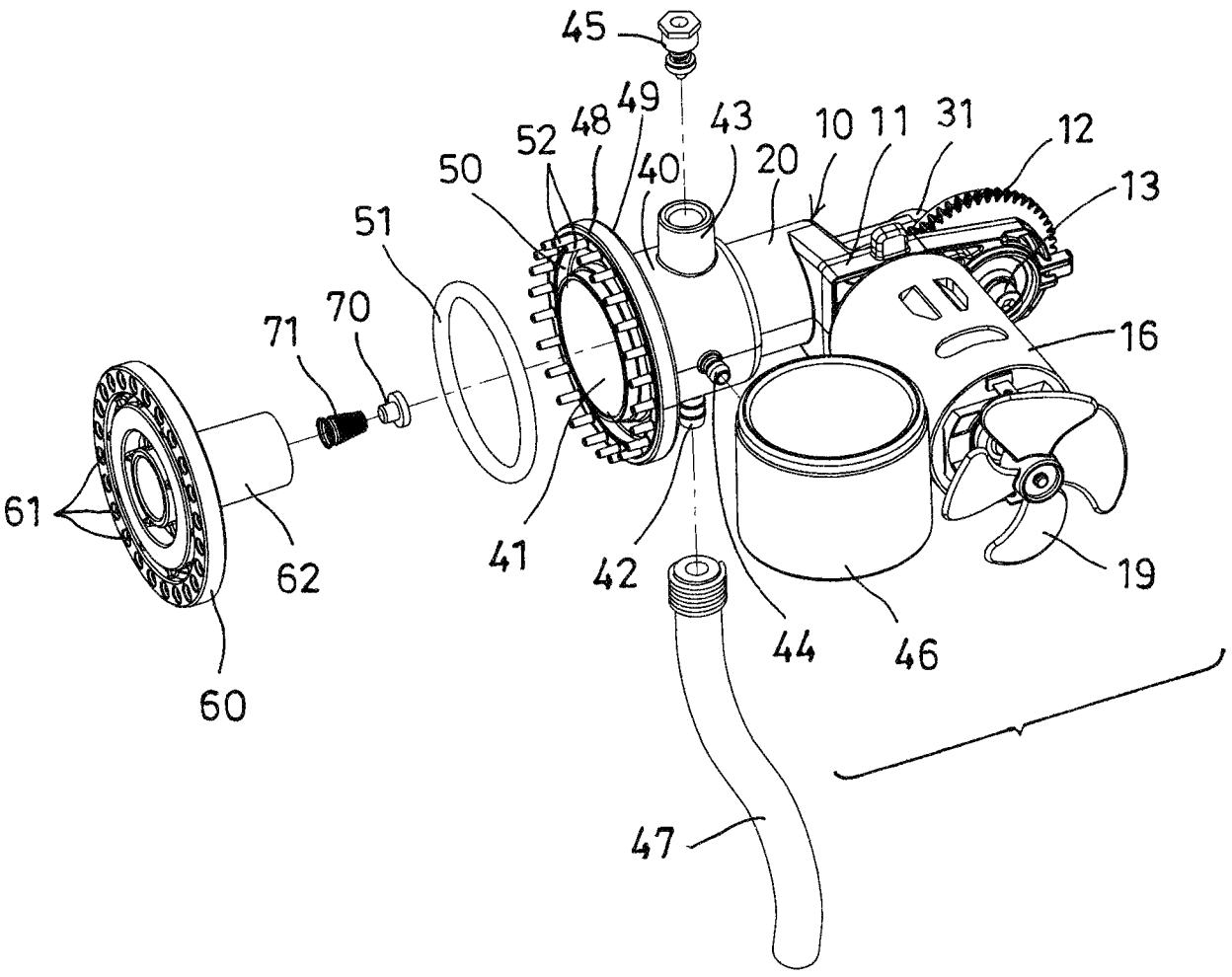
FIG. 1 is a partial exploded view of an air compressor in accordance with the present invention.
Figure 2:
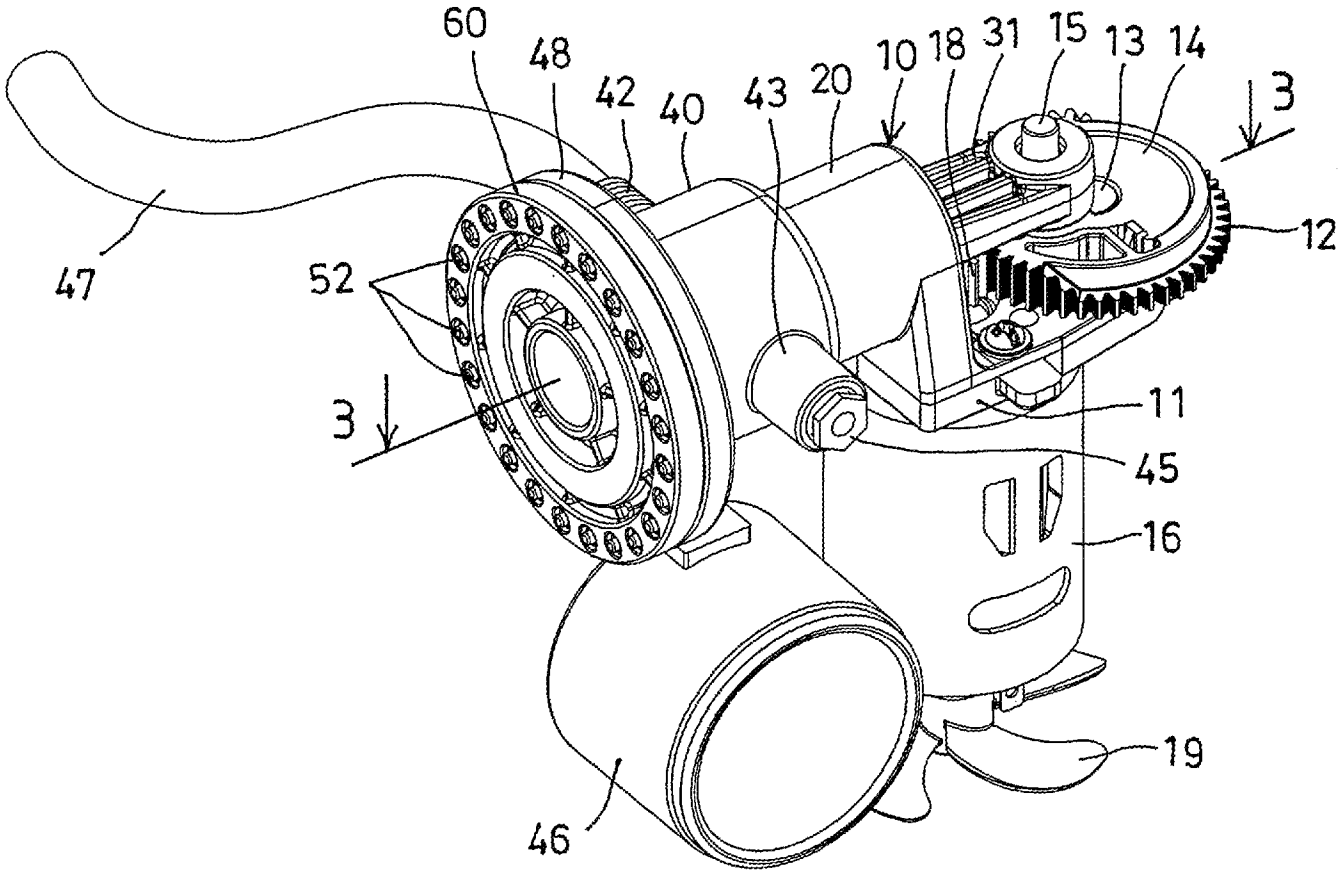
FIG. 2 is a perspective view of the air compressor.

Referring to the drawings, and initially to FIGS. 1-4, an air compressor in accordance with the present invention comprises a supporting base 10 including a supporting plate 11 and a cylinder housing 20 provided on or extended from the supporting plate 11 and preferably, but not necessarily formed integral with the supporting plate 11, for example, the supporting plate 11 and the cylinder housing 20 may be formed integral with each other, as shown in FIGS. 1-2 and 5-6, with the molding or mold-injection processes, for example, or alternatively, the cylinder housing 20 may include one or more projections (not shown) extended therefrom and engaged with corresponding hubs or tubular members (not shown) of the supporting plate 11 for detachably attaching or mounting or securing the cylinder housing 20 to the supporting plate 11.

The cylinder housing 20 includes a chamber 21 formed therein and formed or defined by an inner peripheral surface for slidably receiving or engaging with a piston 30 therein, the piston 30 includes an extension or piston rod 31 extended therefrom and is slidable in a reciprocating action in the chamber 21 of the cylinder housing 20 for generating pressurized air. A gear 12 is rotatably attached to the lower portion of the supporting plate 11 with one or more bearings (not shown) and a shaft 13, and an eccentric member 14 attached or secured to the gear 12 with such as fasteners (not shown) or with the molding or mold-injection processes and may thus be rotated in concert with the gear 12, and includes a crank or an eccentric pin 15 extended therefrom and coupled to the piston rod 31 of the piston 30 in order to actuate or to move the piston 30 relative to the cylinder housing 20 in reciprocating actions.

A motor 16 may be attached or secured to the upper portion of the supporting plate 11 with such as fasteners (not shown), and includes a spindle 17 extended through the supporting plate 11 (FIG. 5), and includes a pinion 18 secured to the spindle 17 thereof, and engaged with the gear 12, for allowing the gear 12 to be rotated or driven by the motor 16 with the pinion 18, and thus for allowing the piston 30 to be actuated or moved relative to the cylinder housing 20 in reciprocating actions by the eccentric member 14 and the eccentric pin 15. A fan device 19 may further be provided and coupled to the motor 16 for being rotated or driven by the motor 16 to generate circulating or ventilating air.

The cylinder housing 20 includes an outlet tube or receptacle 40 extended upwardly or outwardly from the top thereof, and having a compartment 41 formed therein (FIGS. 3, 5-8, 11-12) and communicative with the chamber 21 of the cylinder housing 20, for receiving the pressurized air from the chamber 21 of the cylinder housing 20. For example, the cylinder housing 20 includes an upper wall or partition 22 formed or provided between the cylinder housing 20 and the outlet receptacle 40 and includes an air passage 23 formed in the partition 22 for allowing the pressurized air to be supplied from the chamber 21 of the cylinder housing 20 to the compartment 41 of the outlet receptacle 40.

The outlet receptacle 40 further includes one or more ducts 42, 43, 44 extended outwardly therefrom and communicative with the compartment 41 of the outlet receptacle 40, for receiving the pressurized air from the compartment 41 of the outlet receptacle 40. The ducts 42, 43, 44 may be coupled to various kinds of facilities that require pressurized air supplied thereto. For example, a relief valve 45 (FIGS. 1-4) may be provided and attached to one of the ducts 43 for relieving the pressurized air when the air pressure within the cylinder housing 20 and/or the outlet receptacle 40 is over a predetermined pressure, and thus for preventing the cylinder housing 20 and/or the outlet receptacle 40 from being over-pressurized and damaged.

A pressure gauge 46 may be provided and attached to the other duct 44 (FIGS. 1-2, 5-6) for detecting and showing the air pressure within the cylinder housing 20 and/or the outlet receptacle 40. A nozzle (not shown) may be provided and attached to another duct 42 with a hose 47 for allowing the pressurized air to be supplied from the chamber 21 of the cylinder housing 20 and the compartment 41 of the outlet receptacle 40 to various pneumatic facilities that require pressurized air supplied thereto, with the nozzle. A further relief valve or safety valve (not shown) or the like may further be provided and attached to the other duct (not shown) for relieving the pressurized air when the air pressure within the cylinder housing 20 and the outlet receptacle 40 is over a predetermined value.

It is to be noted that the provision or the extension of the ducts 42, 43, 44 from the outlet receptacle 40 allows the relief valve 45 and the pressure gauge 46 and the nozzle to be easily and readily attached to or coupled to the outlet receptacle 40 with the ducts 42, 43, 44, without additional or specialized coupling members or tools. One or more lids (not shown) may further be provided and attached or secured to either of the ducts 42, 43, 44 with such as a threading engagement, for selectively enclosing or blocking the ducts 42, 43, 44, when the ducts 42, 43, 44 are not required to be used, or when the relief valve 45 and the pressure gauge 46 and the nozzle are not attached or secured to the ducts 42, 43, 44. The above-described structure or configuration for the air compressor is typical and is not related to the present invention and will not be described in further details.

Figure 3:
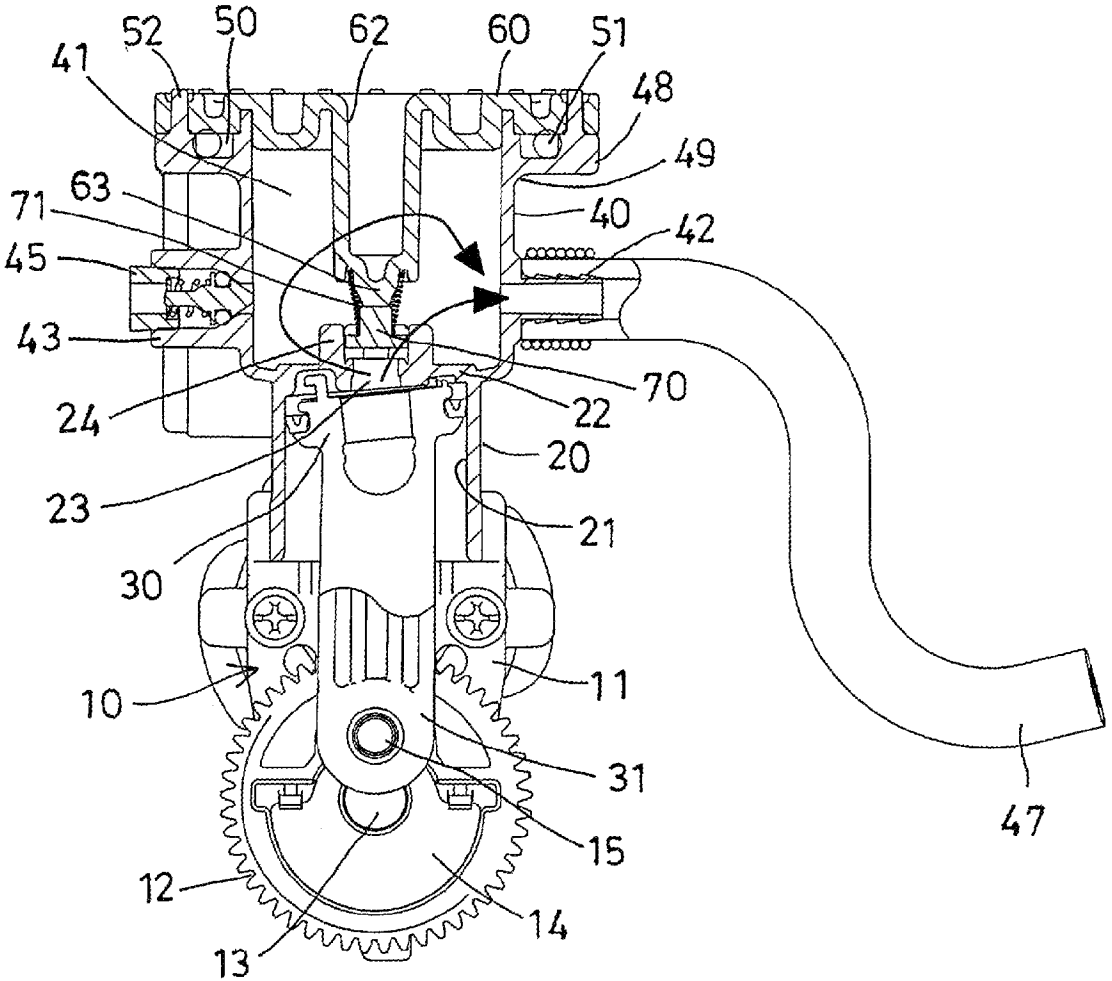
FIG. 3 is a partial cross sectional view of the piston and the piston rod, taken along lines 3-3 of FIG. 2.

In operation, as shown in FIG. 3, the piston 30 may be actuated or moved relative to the cylinder housing 20 in reciprocating actions by the motor 16 with the pinion 18, the gear 12, the eccentric member 14 and the eccentric pin 15, in order to generate a pressurized air, and to allow the pressurized air to flow into the outlet receptacle 40, and then to flow out through either or all of the ducts 42, 43, 44, and thus to allow the air pressure within the cylinder housing 20 and/or the outlet receptacle 40 to be detected and shown by the pressure gauge 46, and to allow the pressurized air to be supplied into the facilities that require pressurized air supplied thereto, with the nozzle, and/or to allow the pressurized air to be relieved via the relief valve 45 when the cylinder housing 20 and/or the outlet receptacle 40 is over-pressurized.

The outlet receptacle 40 includes a peripheral flange 48 formed or provided on the upper portion or the outer portion 49 thereof and extended radially and outwardly from the outer peripheral portion thereof, and includes a peripheral recess 50 formed in the peripheral flange 48 for selectively receiving or engaging with a sealing ring 51, and includes a number of projections or pins 52 extended outwardly from the outer peripheral portion of the peripheral flange 48 and arranged parallel to the cylinder housing 20 and the outlet receptacle 40. A cap or cover 60 may further be provided and attached to the outer or free end of the outlet receptacle 40 and engaged with the sealing ring 51 for blocking or enclosing or sealing the compartment 41 of the outlet receptacle 40, and includes a number of orifices 61 formed therein (FIG. 1) for receiving or engaging with the pins 52 which may be riveted or deformed to solidly secure or retain the cover 60 to the outer or free end of the outlet receptacle 40.

A spring-biased check valve 70 (FIG. 3) is disposed in the outlet receptacle 40 or on top of the partition 22 of the cylinder housing 20, and engaged with a valve seat or the partition 22 that is formed or provided between the outlet receptacle 40 and the cylinder housing 20 for selectively blocking or enclosing or sealing the air passage 23 of the partition 22, and the spring-biased check valve 70 may be used to limit and to guide the pressurized air to flow only from the chamber 21 of the cylinder housing 20 into the compartment 41 of the outlet receptacle 40, and to prevent the pressurized air from flowing backwardly from the compartment 41 of the outlet receptacle 40 into the chamber 21 of the cylinder housing 20.

The cover 60 includes an extension 62 extended downwardly therefrom or extended into the compartment 41 of the outlet receptacle 40, and includes a lower or free end or protrusion 63 extended from or provided on the extension 62 and extended or directed toward the spring-biased check valve 70 for stably retaining or confining the spring-biased check valve 70 within the compartment 41 of the outlet receptacle 40. For example, a spring biasing member 71 may be provided and engaged between the protrusion 63 of the extension 62 of the cover 60 and the spring-biased check valve 70 for biasing and forcing the spring-biased check valve 70 to selectively engage with the partition 22 and to selectively block or enclose or seal the air passage 23 of the partition 22.

Figure 4:
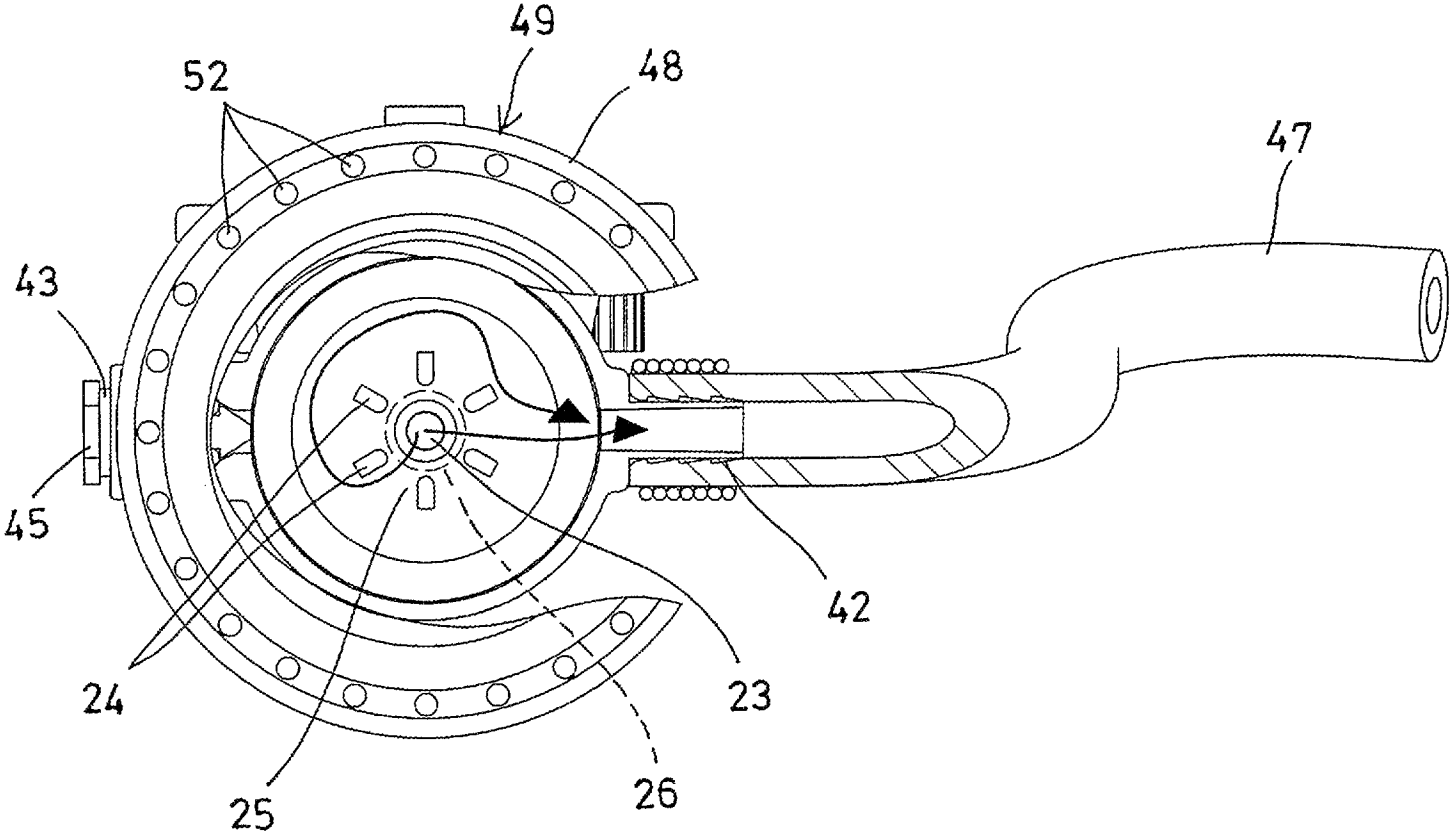
FIG. 4 is a partial plan schematic view of the air compressor illustrating the operation of the air compressor.

As shown in FIGS. 3, 4, the outlet receptacle 40 or the cylinder housing 20 includes a number of projections or pegs 24 extended from the partition 22 and extended into the compartment 41 of the outlet receptacle 40, and includes a number of gaps 25 formed or defined between the pegs 24, and includes a space 26 formed or defined within the pegs 24, in which the space 26 that is formed or defined within the pegs 24 includes an inner diameter greater than that of the air passage 23 of the partition 22 for slidably receiving or engaging with the check valve 70 therein and for confining or retaining the check valve 70 within the space 26 of the pegs 24 and for guiding the check valve 70 to move relative to the outlet receptacle 40 and/or the cylinder housing 20, and also for allowing the pressurized air to flow through the gaps 25 that are formed or defined between the pegs 24.

Figure 6:
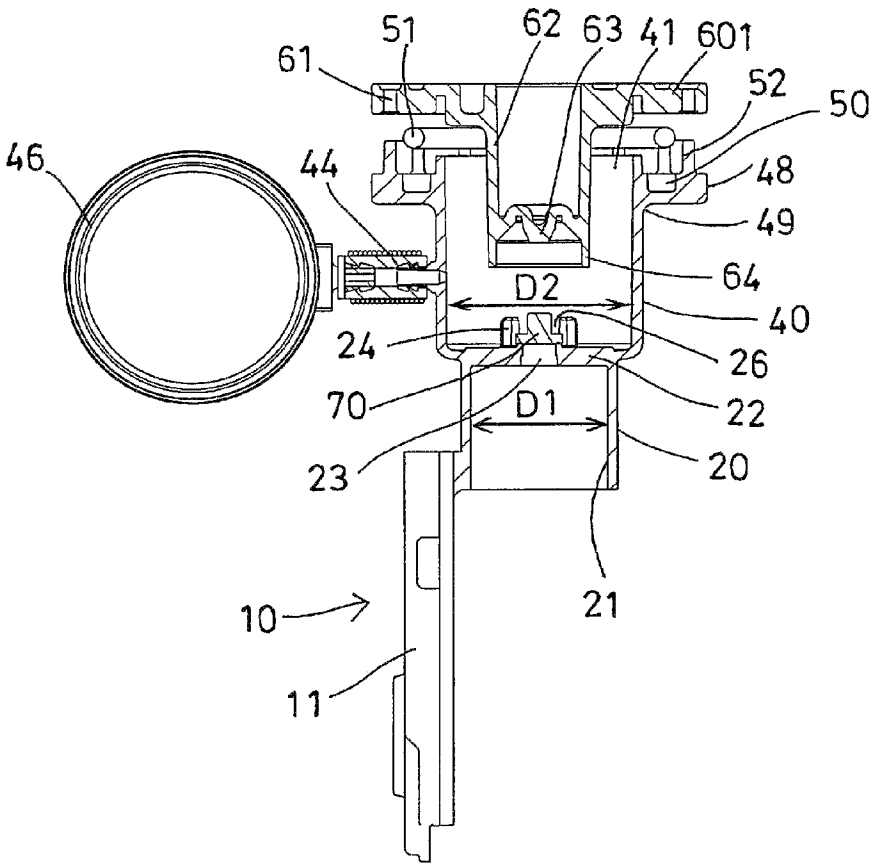
FIG. 6 is a further partial cross sectional and partial exploded view similar to FIG. 5, in which some of the parts or elements have been removed for showing the inner structure of the air compressor.

As also shown in FIG. 6, the inner diameter "D1" of the chamber 21 of the cylinder housing 20 is equal to or less than or no greater than the inner diameter "D2" of the compartment 41 of the outlet receptacle 40, or the inner diameter "D2" of the compartment 41 of the outlet receptacle is equal to or greater than or no less than the inner diameter "D1" of the chamber 21 of the cylinder housing 20 for allowing the pressurized air compressed or pumped by the piston 30 to easily flow through the air passage 23 of the partition 22, and to easily flow into the compartment 41 of the outlet receptacle 40, and thus for allowing the piston 30 to be actuated or moved relative to the cylinder housing 20 in a greater moving speed by the eccentric member 14 and the eccentric pin 15.

Figure 5:
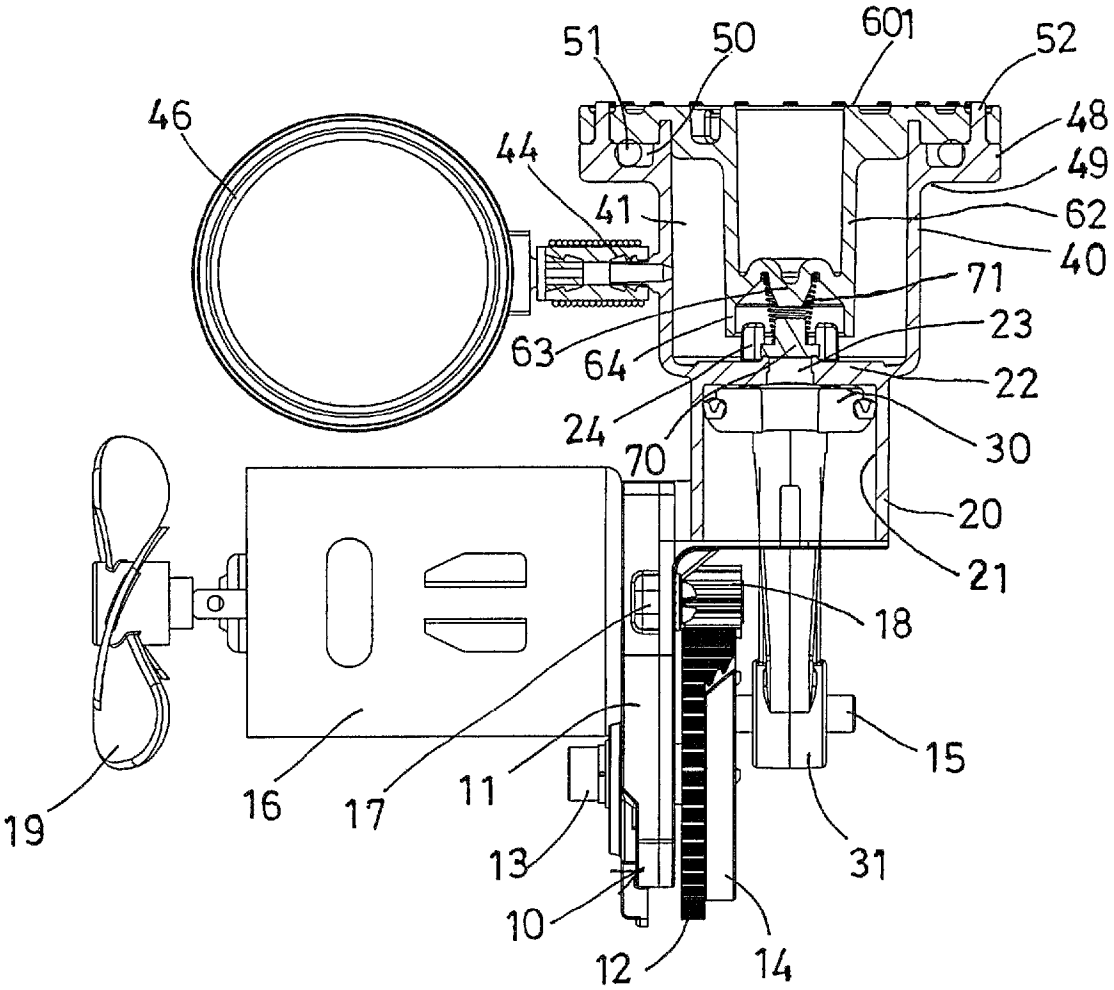
FIG. 5 is another partial cross sectional view illustrating the other arrangement of the air compressor.
Figure 7:
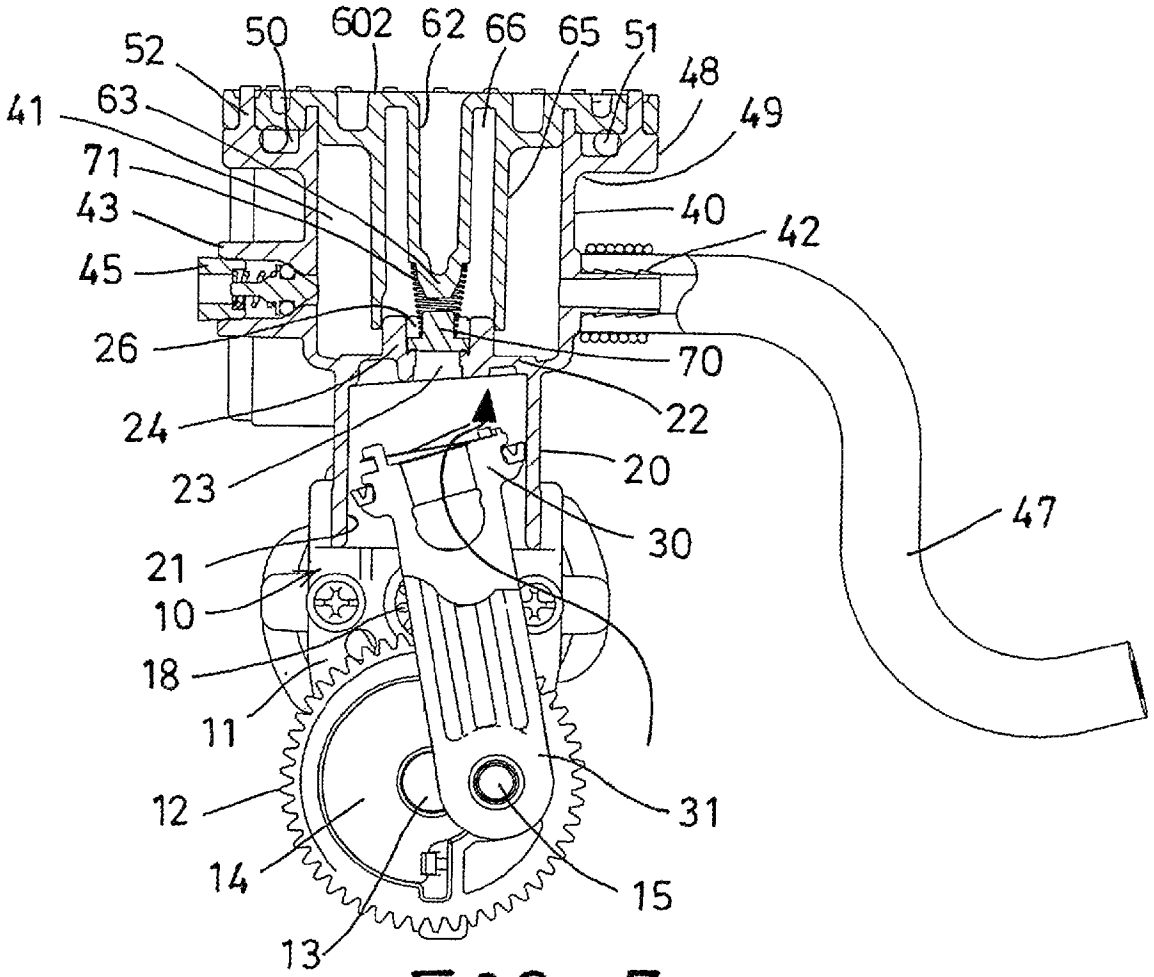
FIG. 7 is a still further partial cross sectional view illustrating the further arrangement of the air compressor.

Alternatively, as shown in FIGS. 5 and 6, the cover 601 may include a peripheral skirt or wall or fence 64 formed or provided on the lower portion thereof for partially engaging with the pegs 24, and also for allowing the pressurized air to flow through the gaps 25 that are formed or defined between the pegs 24. Further alternatively, as shown in FIG. 7, the cover 602 may include a peripheral skirt or wall 65 extended downwardly therefrom or extended into the compartment 41 of the outlet receptacle 40, and located or arranged around the extension 62 for forming or defining an annular space 66 between the extension 62 and the peripheral wall 65 and for partially engaging with the pegs 24.

Figure 8:
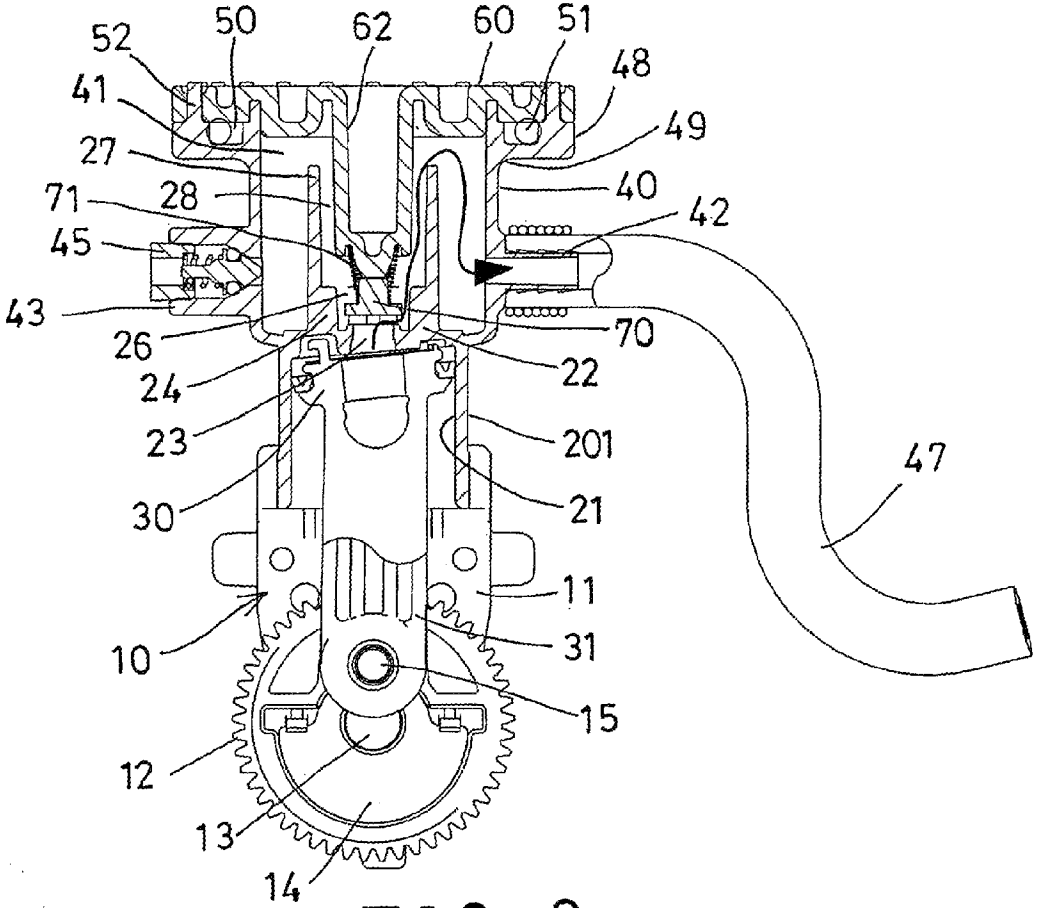
FIG. 8 is a still further partial cross sectional view illustrating the still further arrangement of the air compressor.
Figure 10:
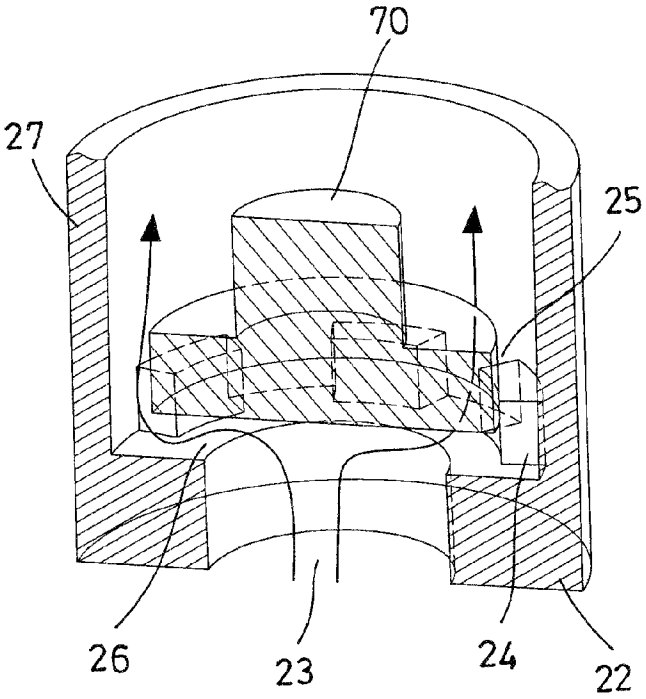
FIGS. 9 and 10 are enlarged partial cross sectional views illustrating the operation of the check valve device for the air compressor.
Figure 9:
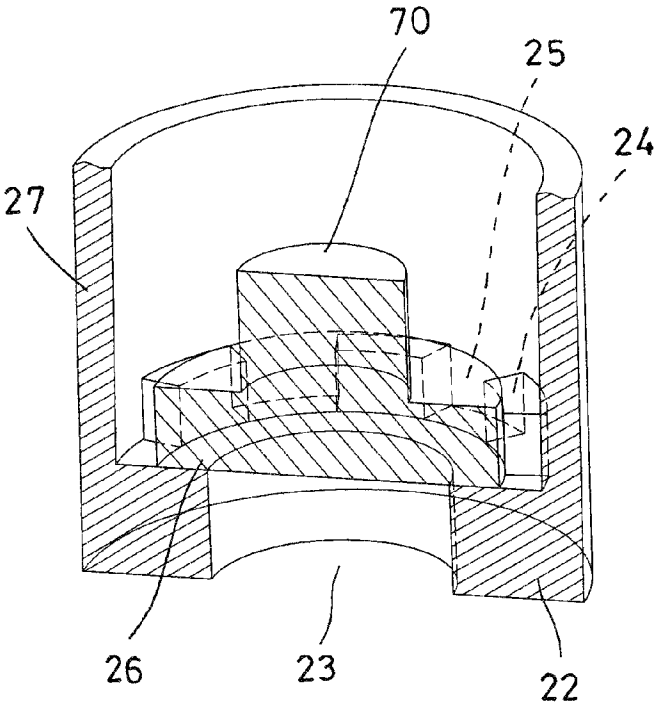
Figure 11:
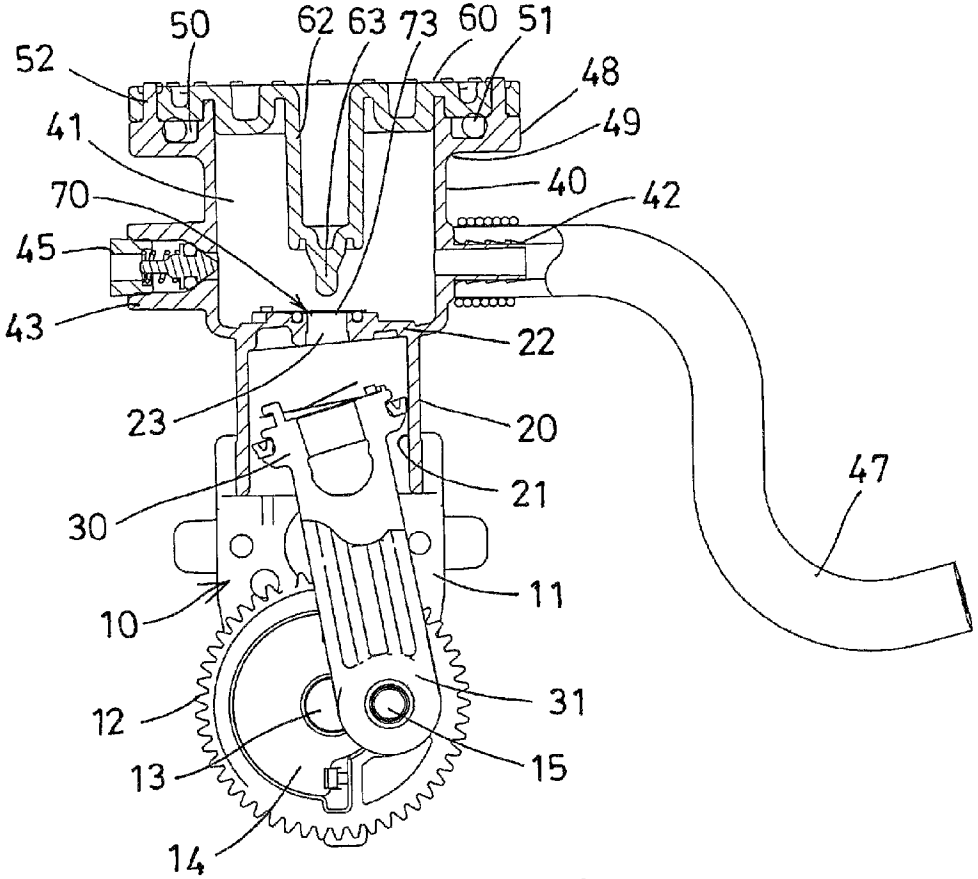
FIGS. 11 and 12 are further partial cross sectional views illustrating the further arrangement of the air compressor.
Figure 12:
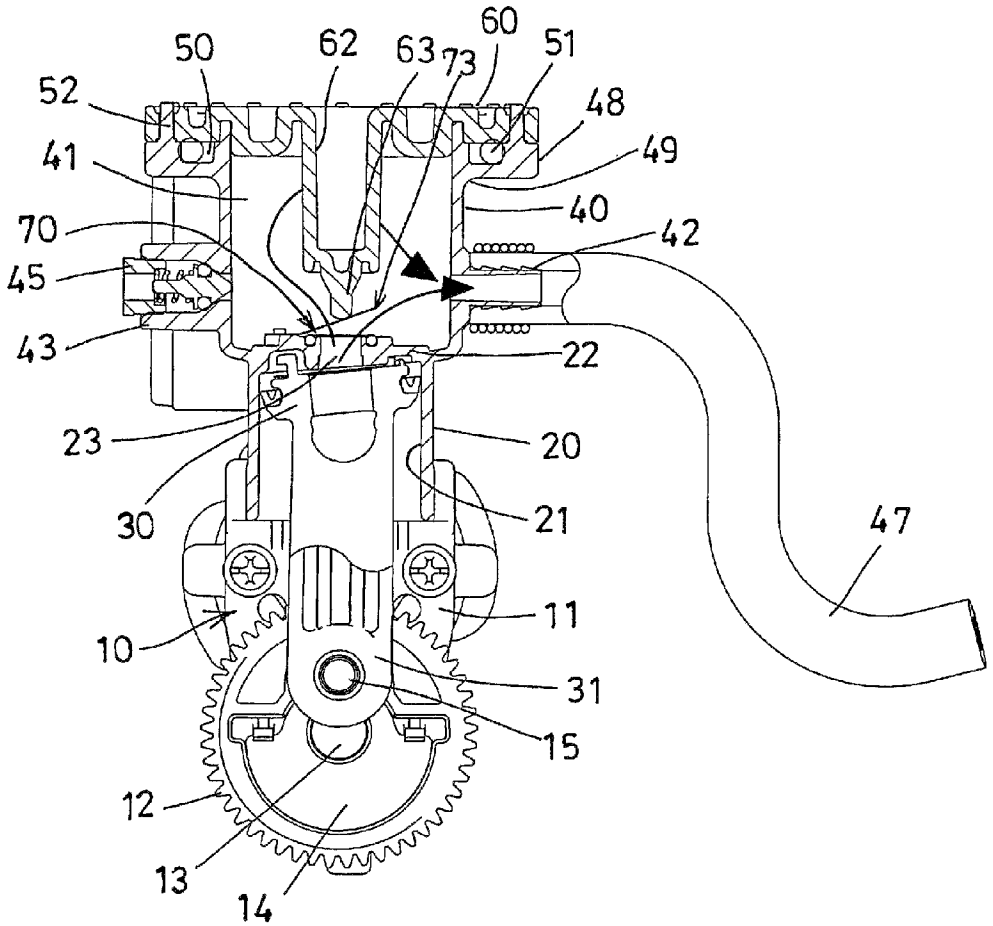

Further alternatively, as shown in FIGS. 8-10, the outlet receptacle 40 or the cylinder housing 201 includes a peripheral skirt or fence 27 extended from the partition 22 and extended into the compartment 41 of the outlet receptacle 40, and located or arranged around the outer portion of the pegs 24 for forming or defining an annular space 28 between the extension 62 and the peripheral fence 27, the peripheral fence 27 is short and do not contact or engage with the cover 60 for allowing the pressurized air to flow through the annular space 28 and to flow over the peripheral fence 27 and to flow into the compartment 41 of the outlet receptacle 40. Further alternatively, as shown in FIGS. 11-12, the spring-biased check valve 70 may include a spring blade 73 attached or mounted or secured to the partition 22 for selectively blocking or enclosing or sealing the air passage 23 of the partition 22.

Accordingly, the air compressor in accordance with the present invention includes an enlarged compartment for receiving a pressurized air and for effectively compressing or pumping the air in the pumping movement or stroke and/or for suitably increasing the compressing or pumping effect or operation to the air.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a cylinder housing including a chamber formed therein, an outlet receptacle provided on said cylinder housing and including a compartment formed therein, and including a partition provided between said cylinder housing and said outlet receptacle, and including an air passage formed in said partition and communicative with said chamber of said cylinder housing for receiving a pressurized air from said chamber of said cylinder housing, and communicative with said compartment of said outlet receptacle, a piston slidably received in said chamber of said cylinder housing and having a piston rod extended therefrom, a motor coupled to said piston for moving said piston relative to said cylinder housing in a reciprocating action in order to generate a pressurized air and for allowing the pressurized air to be supplied from said chamber of said cylinder housing to said compartment of said outlet receptacle, and a spring-biased check valve disposed in said outlet receptacle and engaged with said partition for selectively blocking said air passage of said partition and for guiding the pressurized air to flow from said chamber of said cylinder housing into said compartment of said outlet receptacle, and to prevent the pressurized air from flowing backwardly from said compartment of said outlet receptacle into said chamber of said cylinder housing, wherein:

a cover is attached to said outlet receptacle and includes an extension extended into said compartment of said outlet receptacle and extended and directed toward said check valve, and an annular space is formed between said extension and said peripheral fence, said peripheral fence is short and does not contact with said cover, and said compartment of said outlet receptacle includes an inner diameter D2 no less than an inner diameter D1 of said chamber of said cylinder housing, and said cylinder housing includes a peripheral fence extended from said partition and extended into said compartment of said outlet receptacle and located around a plurality of pegs.

* * * * *